US005788162A

United States Patent [19]

Kurtz

[11] Patent Number: 5,788,162

[45] Date of Patent: Aug. 4, 1998

[54] APPLICATION UNIT FOR DIRECTLY OR INDIRECTLY APPLYING A FLUID OR PASTY MEDIUM TO A CONTINUOUS MATERIAL WEB

[75] Inventor: Rüdiger Kurtz, Heidenheim, Germany

[73] Assignee: Voith Sulzer Papiermaschinen, GmbH, Heidenheim, Germany

[21] Appl. No.: 775,463

[22] Filed: Dec. 30, 1996

[30] Foreign Application Priority Data

Dec. 29, 1995 [DE] Germany ..... 295 20 678 U

[51] Int. Cl.[6] ..... B05B 1/26

[52] U.S. Cl. ..... 239/521; 239/455; 239/518; 118/413; 118/419; 118/126

[58] Field of Search ..... 239/455, 518, 239/521; 118/413, 419, 126

[56] References Cited

U.S. PATENT DOCUMENTS

| | | | |
|---|---|---|---|
| 1,484,705 | 2/1924 | Frothingham et al. | 118/413 X |
| 2,139,628 | 12/1938 | Terry | 239/569 |
| 4,106,429 | 8/1978 | Phillips | 118/413 X |
| 4,387,663 | 6/1983 | Alheid | 118/413 |
| 5,186,753 | 2/1993 | Nakazawa et al. | 118/410 |
| 5,588,998 | 12/1996 | Koskinen | 118/419 X |
| 5,603,767 | 2/1997 | Damrau | 118/413 X |

FOREIGN PATENT DOCUMENTS

| | | |
|---|---|---|
| 701022 | 3/1996 | European Pat. Off. . |
| 2359413 | 6/1975 | Germany . |
| 3731961 | 4/1989 | Germany . |
| 4402626 | 7/1994 | Germany . |
| 9417321 | 1/1995 | Germany . |
| 4327701 | 2/1995 | Germany . |
| 4432177 | 3/1996 | Germany . |
| 95 12031 | 5/1995 | WIPO . |
| 96 07790 | 3/1996 | WIPO . |

OTHER PUBLICATIONS

Patent Abstracts of Japan, vol. 14, No. 211, JP-2-48064, May 2, 1990.

*Primary Examiner*—Andres Kashnikow
*Assistant Examiner*—Robin O. Evans
*Attorney, Agent, or Firm*—Ostrolenk, Faber, Gerb & Soffen, LLP

[57] ABSTRACT

The invention relates to an application unit (2) for directly or indirectly applying a fluid or pasty medium (22) to a continuous material web, particularly one made of paper or cardboard, comprising a metering gap (20) designed as a free-jet nozzle and formed between a leading-side lip (4) and a trailing-side lip (6), and a guiding surface (8) arranged at the free end of leading-side lip (4) or trailing-side lip (6) and adjoining metering gap (20) for the fluid or pasty medium (22). Guiding surface (8) above the outflow of metering gap (20) is pivotable around an axis running essentially parallel to the application unit's longitudinal extension.

22 Claims, 3 Drawing Sheets

Figure 1:
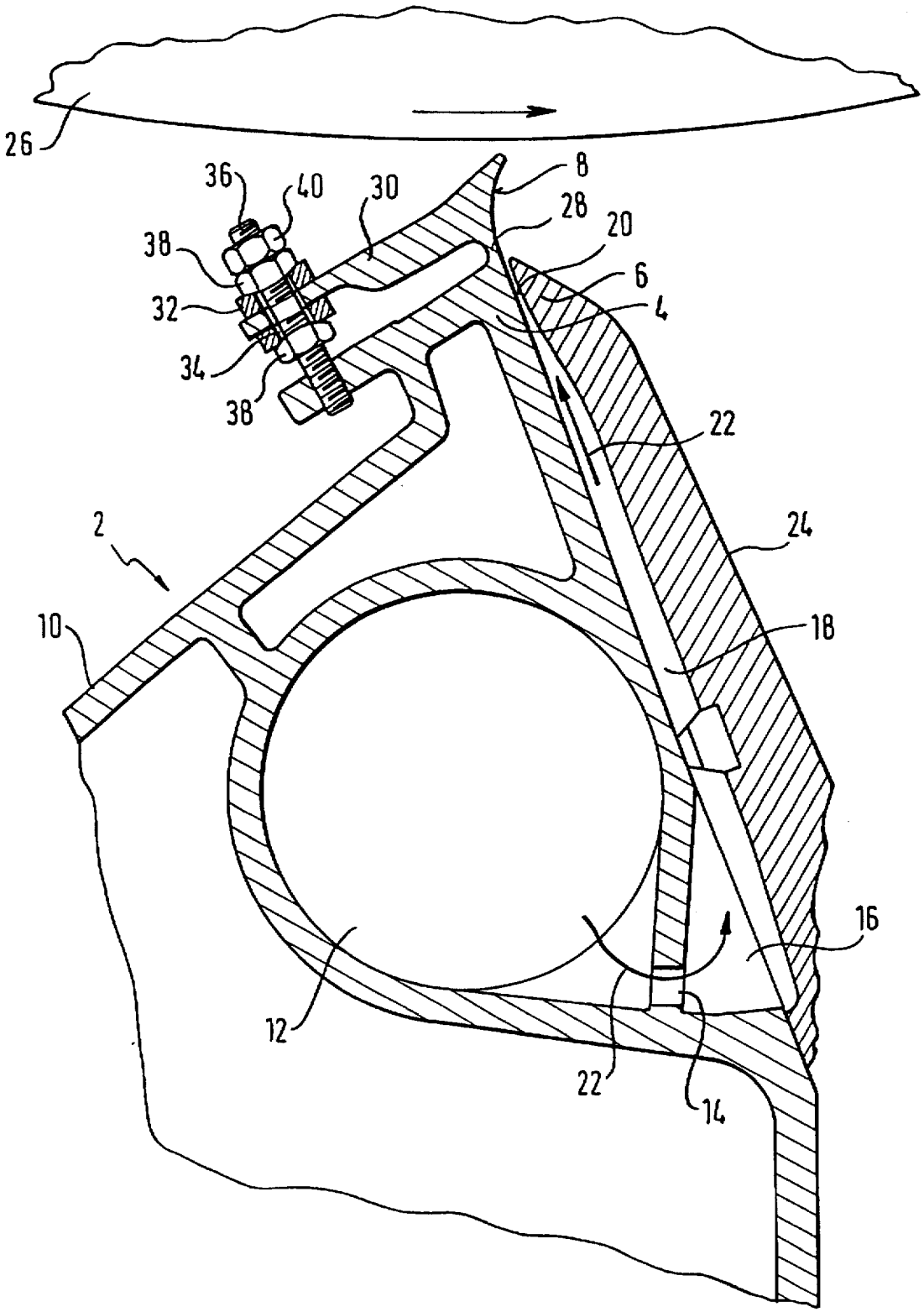

APPLICATION UNIT FOR DIRECTLY OR INDIRECTLY APPLYING A FLUID OR PASTY MEDIUM TO A CONTINUOUS MATERIAL WEB

The invention relates to an application unit for applying a fluid or pasty medium to a continuous material web, particularly one made of paper or cardboard.

Such an application unit for applying a fluid or pasty medium to a continuous material web is known from the Applicant's utility model G 94 17 321.4, whereby the zone in which the application medium is applied to the material web running on a roll starts at an application chamber connected to a central distribution pipe or at a metering gap formed as a free-jet nozzle between a lip on the leading side and a lip on the trailing side. If the metering gap formed as a free-jet nozzle is used, a concavely curved guiding surface adjoining the metering gap is provided for the fluid or pasty medium at the free end of the leading-side lip. The entire application unit is pivotable around an axis parallel to the roll's center axis in order to adjust the angular position of the application chamber or the free-jet nozzle in relation to the tangent to the continuous material web, with the axis being at least approximately located on the extension of a straight line which starting at the roll's center axis runs through a point close to the application zone.

In this manner, it is possible to pivot the entire application unit into a servicing position, for example for maintenance or cleaning purposes. Because this application unit can be pivoted, it is also possible to vary to a certain degree the jet impact angle of the fluid or pasty medium emerging from the free-jet nozzle. As a result of the very large distance of the free-jet nozzle in relation to the application unit's pivoting axis, the impact angle is, however, variable only within a very limited angle range, whereas a disadvantageous large shift of the "impact line" of the fluid or pasty medium on the continuous material web simultaneously arises.

An application unit for applying a fluid or pasty medium to a continuous material web is also known from U.S. 5,186,753; this unit comprises a metering gap formed between a leading-side lip and a trailing-side lip, and a concave guiding surface for the fluid or pasty medium, arranged at the free end of the trailing-side lip and adjoining the metering gap, whereby the entire nozzle chamber including its support beam is pivotable so as to vary the impact angle of the fluid or pasty medium—it is in fact pivotable around an axis located in the proximity of the "impact line" of the fluid or pasty medium on the continuous material web. In this way, the impact angle can be adjusted within a relatively broad range without any noticeable change in the distance between the nozzle head and material web. This solution does, however, necessitate a highly intricate, heavy and expensive pivoting mechanism which must be provided in addition to a pivoting device required for cleaning purposes.

In the known application units, an adjustment of the fluid or pasty medium's impact angle to the application roll or the continuous material web has therefore hitherto been realizable only in a relatively limited angle range or on the other hand only by means of highly intricate, heavy and expensive auxiliary apparatus that in turn entails complicated adjustment mechanisms.

The invention is therefore based on the object of providing an application unit which can be used in a simple and effective manner to adjust the fluid or pasty medium's impact angle to the application roll or the continuous material web within a broad angle range. This object is solved by an application unit according to the invention for directly or indirectly applying a fluid or pasty medium to a continuous material web, particularly one made of paper or cardboard, comprising a metering gap designed as a free-jet nozzle and formed between a leading-side lip and a trailing-side lip, and a guiding surface arranged at the free end of the leading-side lip or the trailing-side lip and adjoining metering gap for the fluid or pasty medium. The guiding surface located above the outflow from the metering gap is pivotable around an axis running essentially parallel to the longitudinal extension of the application unit.

In the solution according to the invention, the guiding surface above the outflow of the metering gap is designed to be pivotable around an axis running essentially parallel to the application unit's longitudinal extension.

The application unit according to the invention makes it possible in an advantageous, simple and effective manner to adjust the fluid or pasty medium's impact angle to the application roll or the continuous material web within a large angle range. For this purpose, all that is necessary is to adjust, i.e. pivot, a very small component of the application unit, viz. the guiding surface, thereby considerably reducing manufacturing outlay and production costs. The forces acting on the application unit's structural components as a result of adjusting or varying the guiding surface can also be kept small and hence a simple and inexpensive design can be achieved. This is also desirable in technical and economic terms. Furthermore, in contrast to known application units, the entire nozzle chamber including the normally used support beam can, in the case of the invention's application unit with its special impact angle adjustment, remain in a normal fixed working position, thus dispensing with intricate and expensive adjustment mechanisms. Any bearing plays of such adjustment mechanisms are not present either and hence do not exert any influence on the impact angle, enabling the impact angle to be adjusted with extreme precision. Since the pivoting axis of the guiding surface is in direct proximity to the material web, the shift of the fluid or pasty medium's "impact line" on the continuous material web is insignificantly small when the impact angle is varied. Finally, as a result of its simple impact-angle adjustment device, the application unit according to the invention can be cleaned more easily and with less effort. For this purpose, it is possible to provide a front flap or the like encompassing the trailing-side lip, the design of which flap can be realized particularly simply as compared to conventional application units.

An advantageous embodiment feature of the invention envisages that the guiding surface above the outflow of the metering gap is pivotably formed in a zonal manner around an axis running essentially parallel to the application unit's longitudinal extension. For this purpose, the guiding surface is expediently subdivided in a zone-like manner. In this way, the fluid or pasty medium's impact angle can be locally varied to the continuous material web and hence the application to the application roll or material web can be correspondingly influenced. This may for example be useful for compensating local production inaccuracies or for producing a specific cross section on the material web. By pivoting the guiding surface in an even and zonal manner, a uniform adjustment of the impact angle across the entire length of the application unit is of course to be achieved in the same way.

A further advantageous embodiment feature of the invention envisages that in the area of the metering gap's outflow, a jointed or hinged device is provided in the leading-side and/or trailing-side lip and/or in an application-unit component assigned to the guiding surface, with this jointed or hinged device ensuring that the guiding surface can be pivoted. In the invention's sense, a component assigned to the guiding surface is to be defined for example as a special mount or the like for the guiding surface, whereby depending on requirements, this mount can be arranged on the leading-side or the trailing-side lip or on another suitable component of the application device. In principle, any device suitable for the intended purpose may be considered as a jointed or hinged device, though importance should be attached to creating as beneficial a transition as possible in terms of flow between the metering gap's outflow and the guiding surface. Consequently, an impact angle adjustment can in turn be realized in a particularly simple manner.

If in the area of the metering gap's outflow, a local thin part is provided in the leading-side and/or trailing-side lip and/or in an application-unit component assigned to the guiding surface, with this local thin part ensuring that the guiding surface can be pivoted as a result of flexible deformation, the desired adjustment or variation of the guiding surface can be accomplished extremely easily and effectively. The local thin part therefore acts as a hinge and also enables a transition that is very beneficial in terms of the fluid or pasty medium's flow at the variation site.

It has also proved particularly advantageous for the jointed or hinged device or the local thin part to be located within a range of about 0 mm to 20 mm above the metering gap's outflow, i.e. above the greatest extension of the leading-side and/or trailing-side lip. If when looking in the fluid or pasty medium's direction of flow, the position of the jointed or hinged device or of the local thin part is situated essentially above the metering gap, the impact angle adjustment can be performed independently of a metering-gap variation. With regard to the precise position of the jointed or hinged device or local thin part, the invention is not, however, restricted to the aforementioned special range. On the contrary, the position of the jointed or hinged device or local thin part may considerably deviate from the above values, depending on the application unit and respective requirements.

According to the invention, at least one setting device is advantageously provided for pivoting the guiding surface. If a plurality of setting devices is used, they can also be distributed across the length of the application unit. This embodiment is particularly suitable for a guiding surface divided in a zone-like manner. Of course, a separate setting device is to be expediently assigned to each guiding-face zone.

It has also proved advantageous for the setting device to have a mechanical setting mechanism, since it can be used to accomplish the guiding surface's desired pivoting and adjustment particularly easily. A mechanical setting mechanism may for example comprise levers, cams, adjusting screws and the like.

It has also proved to be advantageous for the mechanical setting mechanism to comprise at least one lever arm arrangement which directly or indirectly introduces bending forces into the guiding surface via at least one actuator in order to achieve a pivoting of the guiding surface by means of the resultant bending deformation. This embodiment is particularly suitable in conjunction with the above local thin part that is provided in the area of the metering gap's outflow and ensures that the guiding surface can be pivoted; the local thin part is deformed in a flexible manner, while the guiding surface's geometry is itself essentially unaltered. The lever arm arrangement also enables a simple variation of the guiding surface either across the application unit's entire length or zonally. Bending forces may be introduced indirectly into the guiding surface for example via interposed force-transmission elements or the like.

The mechanical setting mechanism preferably comprises at least one adjustment device which is directly or indirectly supported at the leading-side lip and/or trailing-side lip and/or at a beam of the application unit. If suitably designed, the above-mentioned setting device itself can of course also act as an adjustment device or vice versa. Particularly in conjunction with the aforementioned lever arm arrangement, the guiding surface can therefore be pivoted in the desired manner and the fluid or pasty medium's impact angle can be adjusted with extreme precision by actuating the adjustment device, for example an adjustment screw pre-tensioned by spring elements, a servomotor for precision adjustment or the like. At the same time, the forces arising during pivoting are introduced into the participating components of the application unit in an advantageous manner in terms of design. If a zonally divided and pivotable guiding surface is used, a corresponding number of adjustment devices can be provided.

According to a further advantageous embodiment feature of the invention, the setting device comprises a thermal, hydraulic, pneumatic, electrical, electromagnetic, magnetic, magnetostrictive or piezoelectric setting mechanism. These setting mechanisms can in principle be combined both with each other and with the above-mentioned mechanical setting mechanism; their structural design can also be realized in various ways and adapted to the intended purpose. They are also particularly suitable in conjunction with automatic checking and regulating devices.

A further advantageous embodiment of the invention is for the setting device to be actuated automatically and/or by remote control and/or incorporated into a control loop. This is particularly appropriate in terms of the impact angle adjustment during the application unit's ongoing operation. The setting device can then on the one hand be driven centrally, while on the other it is possible to link in terms of control technology the setting device to other application unit components. This is particularly advantageous if the automatic and/or remote-controlled actuation of the setting device is incorporated into an automatic control loop which on account of measurement values of the cross section or other properties of the applied fluid or pasty medium, readjusts the setting device to adjust the impact angle. This enables the application unit to adapt to altered conditions as quickly as possible, thereby avoiding longer periods of stoppage.

Finally, a further advantageous and expedient embodiment version of the invention provides that by means of the setting device, the leading-side lip is adjustable across the application unit's machine width in a continuous and/or zonal manner. In this solution, the leading-side lip can be adjusted manually and/or automatically during or out of the application unit's ongoing operation. A particular advantage is also obtained by having the leading-side lip and hence the metering gap adjusted independently of the adjustment of the impact angle accomplished by means of the guiding surface, and vice versa. Depending on the type of fluid or pasty medium used and in accordance with other influencing variables, the adjustment of the leading-side lip and of the impact angle can therefore be coordinated with one another so as to achieve a top-quality application. This in turn allows the application unit to be adapted to changing conditions to an optimum extent, particularly during ongoing operation, and contributes toward avoiding longer cost-intensive periods of stoppage.

In particular, straight or curved guiding surfaces have proved to be advantageous for the application unit according to the invention. If a curved guiding surface is used, the guiding surface is preferably concavely curved.

Figure 2:
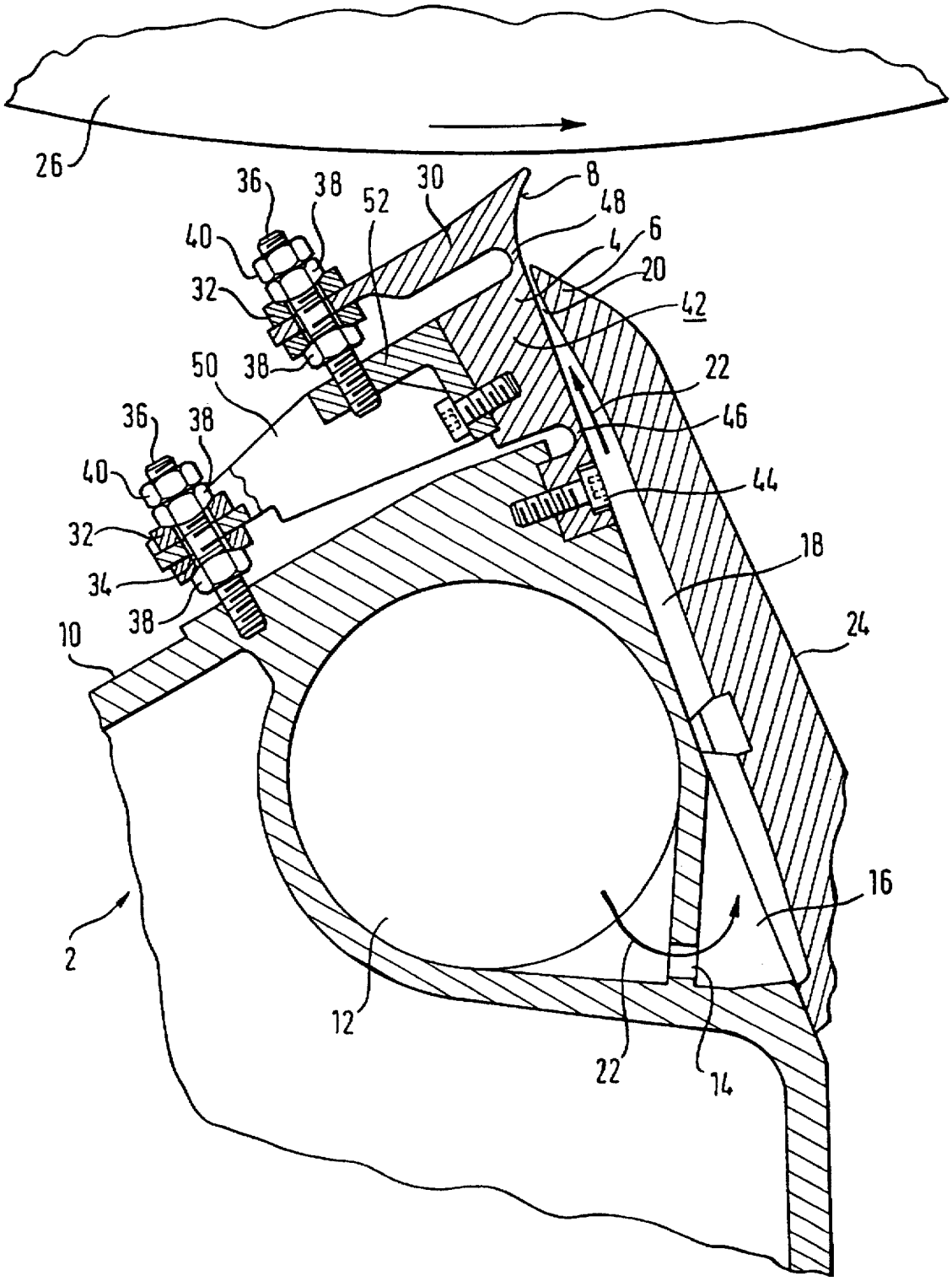
Figure 3:
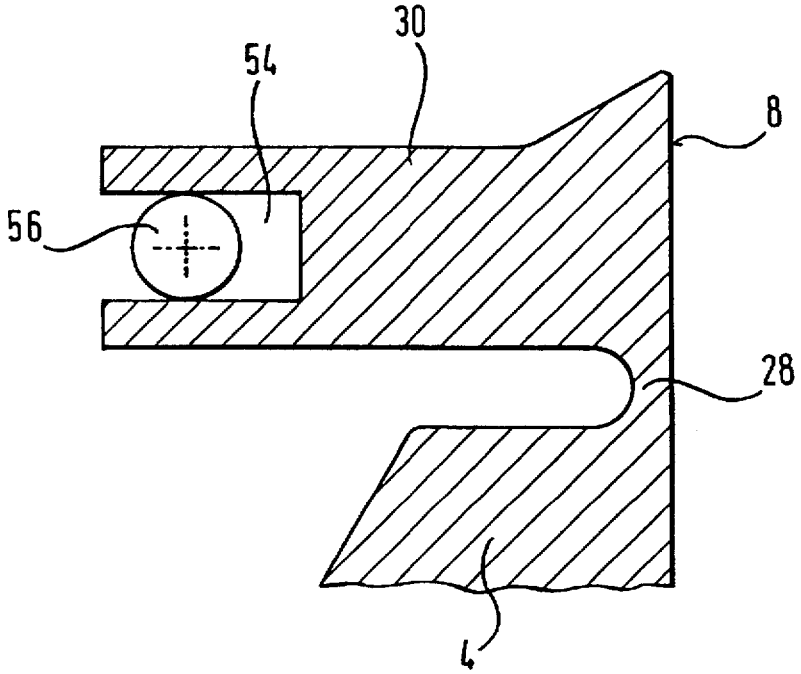

Preferred embodiments of the invention containing additional design details and advantages will be described and explained more closely with reference to the attached drawings as follows:

FIG. 1 shows a schematic cross-sectional representation of a first exemplary embodiment of the application unit according to the invention, FIG. 2 shows a schematic cross-sectional representation of a second exemplary embodiment of the application unit according to the invention, and FIG. 3 shows a schematic cross-sectional view of a guiding surface of the application unit according to the invention, having an associated setting mechanism.

To avoid repetitions, the same components will also be designated by the same reference numerals in the following description and in the Figures, unless further differentiation is necessary.

As shown in FIG. 1 as part of a schematic cross-sectional representation, a first exemplary embodiment of application unit 2 according to the invention comprises a beam 10 that extends across the entire length of application unit 2. A distribution pipe 12 which is also usually designated as a color distribution pipe is formed in beam 10 for the fluid or pasty medium to be applied. An equalizing chamber 16 which continues as a feed duct 18 adjoins distribution pipe 12 via through-openings 14. Feed duct 18 merges into a metering gap 20 that is formed between a leading-side lip 4 and a trailing-side lip 6. A concavely curved guiding surface 8 is formed at the free end of leading-side lip 4 which extends beyond the free end of trailing-side lip 6. The fluid or pasty medium is indicated by arrow 22. A front wall 24, to which trailing-side lip 6 is securely connected, is rigidly fixed during operation, but this wall can, if required, be folded down around a joint not shown in the drawing, such as for cleaning or maintenance purposes.

Opposite application unit 2 is an application roll 26 for the indirect application of medium 22 to be applied. The rotary direction of application roll 26 is illustrated by an arrow. As is evident from the drawing, leading-side lip 4 is located on that side of metering gap 20 on which application roll 26 arrives, i.e. the roll moves toward this side, whereas trailing-side lip 6 is located on the opposite side of metering gap 20, on which side application roll 26 moves away from metering gap 20, i.e. the roll runs off this side.

In this application unit 2, fluid or pasty medium 22 is first fed via color distribution pipe 12, then reaches equalizing chamber 16 via through-openings 14 and flows through feed duct 18 to metering gap 20 from which medium 22 subsequently emerges in a free jet (not depicted), with the application jet being deflected by concavely curved guiding surface 8 of leading-side lip 4 toward the tangent to application roll 26. Fluid or pasty medium 22 is applied in the form of this free jet to the surface of application roll 26 and after passing through a downstream precision metering device (not illustrated), at which the applied medium is scraped off in order to adjust a predetermined cross section, it is then supplied to a roll gap through which there runs a material web composed of paper or cardboard, possibly also composed of a fabric material; at this point, the web receives the fluid or pasty medium from application roll 26.

In the present embodiment of the application unit, concave guiding surface 8 above the outflow of metering gap 20 is designed to be pivotable around an axis running essentially parallel to the longitudinal extension of application unit 2. As is clearly identifiable in FIG. 1, a local thin part 28 is provided for this purpose in leading-side lip 4 in the area of the outflow of metering gap 20, i.e. about 20 mm above metering gap 20 and hence above the largest extension of trailing-side lip 6 (depending on the application and corresponding to the specific requirements, the exact position of the local thin part may, however, considerably deviate from these values). This local thin part 28 corresponds to a hinged connection and ensures as a result of flexible deformation that that portion of leading-side lip 4 located above thin part 28 in the drawing and forming concave guiding surface 8 is pivoted within a specific pivoting range, whereby pivoting takes place around an axis running through thin part 28 and parallel to the longitudinal axis of beam 10. That portion of leading-side lip 4 located below local thin part 28 remains rigid however. In this manner, the impact angle of the fluid or pasty medium's free jet deflected by concave guiding surface 8 can be varied to application roll 26 without having to alter metering gap 20.

As is also apparent from FIG. 1, that side of guiding surface 8 turned away from the metering gap is fitted with a lever arm 30 via which, by applying a leverage, bending forces are introduced into concave guiding surface 8 and local thin part 28 in order to cause guiding surface 8 to pivot by means of the resultant bending deformation at local thin part 28. For this purpose, the application unit is equipped with the following mechanical setting mechanisms or actuators. The end of lever arm 30 facing away from leading-side lip 4 is fitted with a jointed head 32. This jointed head 32 is fitted on to a screw bolt 36 rigidly attached to beam 10 and each held there between two screw nuts 38. Screw nuts 38 each comprise a spherical surface on their end face turned toward jointed head 32. This surface respectively adapts to a cup-shaped joint part that matches the spherical part (ball joint) and is located on the end faces of jointed head 32. Since a through-bore 34 of each spherical head 32 has a greater internal diameter than the external diameter of rigid bolt 36, jointed head 32 can be pivoted within a specific range in relation to bolt 36 without transferring bending forces to the bolt. The two screw nuts 38 on each bolt 36 are also secured by a locking nut 40. The free jet's impact angle can be varied and very accurately adjusted by actuating the previously described setting mechanism which is supported on the one hand at beam 10 and on the other indirectly at leading-side lip 4.

Instead of this purely mechanical setting mechanism, other suitable setting mechanisms are also of course conceivable, such as thermal, hydraulic, pneumatic, electrical, electromagnetic, magnetic, magnetostrictive, piezoelectric and the like as well as combinations thereof. They are particularly provided in conjunction with an automatic and/or remote-controlled variation of concave guiding surface 8, also preferably in conjunction with automatic monitoring and/or regulating devices which, for instance on account of measurement values of the cross section or other properties of the applied fluid or pasty medium, readjust concave guiding surface 8 so as to adjust the impact angle. Such an embodiment is not depicted in the drawing.

The concave guiding surface 8 shown in FIG. 1 may either have an integral design or may be designed to be divided across the length of the application unit into zones which are variable in a manner independent of one another. A separate setting or adjustment device is then to be expediently assigned to each zone of the concave guiding surface.

A second exemplary embodiment of the application unit according to the invention can be inferred from FIG. 2 which represents a schematic cross section. The basic structure of this application unit essentially corresponds to that according to FIG. 1, but unlike the latter it has a specially designed head member 42 which comprises both leading-side lip 4 and concave guiding surface 8 and which if required, simultaneously acts as a metering-gap setting device by means of which the metering gap, i.e. the distance between leading-side lip 4 and trailing-side lip 6, is adjustable across the application unit's entire length in an even or zonal manner, regardless of the impact angle adjustment.

As is evident from FIG. 2, head member 42 is securely connected to beam 10 via attachment screws 44. In the drawing, the right side of head member 42 forms both a wall portion of feed duct 18, metering gap 20 and concave guiding surface 8. Head member 42 is fitted with a first local thin part 46 in a portion located ahead of metering gap 20 when looking in the fluid or pasty medium's flow direction, with the result that the region of head member 42 located above thin part 46 in the drawing and forming leading-side lip 4 is pivotable by a certain amount around an axis running through thin part 46 and essentially parallel to the application unit's longitudinal extension toward trailing-side lip 6 or away therefrom. In this manner an adjustment of metering gap 20 is obtained. In the present instance, head member 42 is arranged across the length of the application unit into a plurality of zones, so that if required, metering gap 20 is also zonally adjustable. Of course a head member that is not divided for the metering gap adjustment can be produced in the same way. A lever arm 50, which is connected to the rear side of head member 42 in a flexurally resistant manner, is assigned to each zone of head member 42. The free end of lever arm 50 is fitted with a setting mechanism 32, 34, 36, 38, 40, as is already known from FIG. 1 in conjunction with concave guiding surface 8. To cause metering gap 20 to be adjusted, lever arm 50 is actuated via setting mechanism 32, 34, 36, 38, 40 or via a suitable actuator, and lever arm 50 secured against bending transfers the variation movement to the corresponding portion of head member 42.

As is also depicted in FIG. 2, head member 42 has a second local thin part 48 which is located in the area above the outflow of metering gap 20 at that portion of head member 42 that forms leading-side lip 4. In this way, the upper region of head member 42 located in the drawing above second thin part 48 and forming concave guiding surface 8 is pivotable by a specific amount around an axis running through second thin part 48 and essentially parallel to the application unit's longitudinal extension. The portion of head member 42 located below second thin part 48 and which acts as a metering-gap setting device behaves like a rigid leading-side lip so long as it is not actuated. The design of concave guiding surface 8 essentially corresponds to that of FIG. 1. Unlike the latter, setting mechanism 32, 34, 36, 38, 40 for concave guiding surface 8 is not, however, directly supported on beam 10, but on a bracket 52 provided on the rear side of head member 42. Yet it is just as conceivable to support the setting mechanism for concave guiding surface 8 on lever arm 50 for metering-gap variation or, with a correspondingly suitable design, on head member 42 itself or even beam 10 or another component. The operating mode of the impact-angle variation achievable by means of the specially designed concave guiding surface 8 according to FIG. 3 essentially corresponds that of FIG. 1 and therefore does not need to be explained further.

What must, however, be emphasized is that by using the invention's embodiment of the application unit according to FIG. 2, both an impact-angle variation and an independent variation of the metering gap can be simultaneously performed, without the two setting mechanisms adversely affecting each other in their respectively chosen settings.

By way of a schematic cross-sectional view, FIG. 3 shows a further embodiment of a guiding surface 8 of the application unit according to the invention with an associated setting mechanism. In contrast to the previously described exemplary embodiments, guiding surface 8 is formed as a straight guiding surface. But otherwise its basic structure substantially corresponds to the designs already explained in conjunction with FIGS. 1 and 2 and is provided for an impact-angle variation across the application unit's entire machine width. For this reason, straight guiding surface 8 is integrally formed. Lever arm 30 of guiding surface 8 is provided at its free end with a groove 54 into which a connecting element 56 of a suitable actuator engages—the actuator is not shown in the drawing for the sake of clarity. If guiding surface 8 is varied by means of the actuator, whereby guiding surface 8 together with adjoining lever arm 30 pivots around the local thin part, connecting element 56 of the actuator can be moved within groove 54, with the result that no bending forces are transferred to the actuator. This is particularly advantageous if the actuator is rigidly connected to the beam or another component of the application unit.

The invention is not limited to the examples explained above and which merely represent preferred embodiments. On the contrary, the application unit according to the invention may considerably differ from the exemplary embodiments, depending on the application. In particular, other suitable setting and adjustment devices or mechanisms can be used. As already mentioned at the outset, these setting devices can be actuated automatically and/or by remote control and/or they can be integrated into a control loop. Instead of the local thin part described above, other jointed or hinged devices are also conceivable in the leading-side and/or trailing-side lip and/or in another application-unit component assigned to the guiding surface, whereby these jointed or hinged devices ensure that the guiding surface can be pivoted. If for example a hinged device is used, additional covers, trims or the like, which are beneficial in terms of flow, may be provided at the components and faces of the application unit that come into contact with the flow of fluid or pasty medium. In particular, guiding surface 8, head member 42 as well as leading-side lip 4 and trailing-side lip 6 can if necessary also be composed of a plurality of individual parts detachably or undetachably connected to one another or they may be produced from suitable identical or different materials. Guiding surface 8 can also be shaped in a manner differing from those forms described above; it may even be convexly curved.

Reference numerals in the claims, specification and drawings merely help the reader to understand the invention better and are not intended to restrict the scope of protection.

LIST OF REFERENCE SYMBOLS

The following are designated:

2 Application unit
4 Lip, leading side
6 Lip, trailing side
8 (Concave) guiding surface
10 Beam
12 Distribution pipe / color distribution pipe
14 Through-openings
16 Equalizing chamber
18 Feed duct
20 Metering gap
22 Fluid or pasty medium 24 Front wall
26 Application roll
28 Local thin part
30 Lever arm
32 Jointed head
34 Through-bore of 32
36 Screw bolts
38 Screw nuts
40 Locking nut
42 Head member
44 Attachment screws
46 First local thin part of 42
48 Second local thin part of 42
50 Lever arms
52 Bracket
54 Groove
56 Connecting element

I claim:

1. Application unit for applying a fluid or pasty medium to an application surface moving past the application unit, application unit comprising:

a free jet nozzle defining a metering gap, wherein the gap extends across the application surface moving past the gap, the nozzle metering gas being defined by a leading side lip defining and being located on the upstream leading side of the gap and a trailing side lip defining and being located on the downstream trailing side of the gap past which the application surface moves, the lips having outlet ends extending toward the application surface;

a fluid or pasty medium guiding surface arranged at the outlet end of one of the lips and extending beyond the metering gap, the guiding surface extending toward the application surface and adjoining the metering gap;

the guiding surface being supported to be pivotable in its orientation with respect to both the application surface and the metering gap for the guiding surface to pivot around an axis extending across the application surface and generally parallel to the longitudinal extension of the application unit and for the guiding surface to be pivotable without corresponding pivoting of the one lip at the metering gap, whereby the metering gap need not be affected by pivoting of the guiding surface.

2. The application unit of claim 1, wherein the guiding surface is arranged at the outlet end of the leading side lip.

3. The application unit of claim 2, wherein the guiding surface is supported and defined so as to be pivotable to respective individual extents around the axis at respective zones along the longitudinal extension of the application unit across the application surface.

4. The application unit of claim 1, wherein the pivotable support of the guiding surface comprises a pivotable hinge and joint between the guiding surface and the one lip in the area of outflow from the metering gap between the lips for enabling the guiding surface to be pivoted.

5. The application unit of claim 4, wherein the hinge and joint between the one lip and the guide surface is located a distance within a range of 0 mm to 20 mm above the outflow from the metering gap toward the application surface.

6. The application unit of claim 4, wherein the application unit includes a stationary beam, and the one lip is supported to the beam;

a separate setting device connected with the one lip in the portion of the one lip defining the metering gap upstream of and before the free jet nozzle, the setting device being adjustable with reference to the beam for adjusting the metering gap;

the hinge and joint being between the one lip and the guiding surface, whereby the position of the one lip with respect to the other lip is adjustable and the position of the guiding surface is independently adjustable with reference to the one lip.

7. The application unit of claim 1, wherein the pivotable support of the guiding surface comprises a localized thin part of the one lip located generally in the area of the outflow of the metering gap between the lips and forming the guiding surface to the one lip, the localized thin part being thin enough to be flexibly deformable to enable the guiding surface to be pivoted at the thin part with respect to the one lip.

8. The application unit of claim 7, wherein the localized thin part is located a distance within the range of 0 mm to 20 mm above the outflow from the metering gap toward the application surface.

9. The application unit of claim 1, further comprising setting means connected with the guiding surface for pivoting the guiding surface with respect to the one lip.

10. The application unit of claim 9, wherein the setting means comprises a mechanical setting mechanism mechanically connected with the guiding surface for pivoting the guiding surface.

11. The application unit of claim 10, wherein the setting mechanism is so connected with the guiding surface along the longitudinal direction of extension of the application unit as to be adjustable in zones along the one lip to respective extends.

12. The application unit of claim 10, wherein the mechanical setting mechanism is supported generally at the one lip for moving the guiding surface with reference to the one lip.

13. The application unit of claim 12, wherein the application unit includes a stationary beam and the one lip is supported to the beam and the mechanical setting mechanism is also supported to the beam.

14. The application unit of claim 1, wherein the guiding surface above the metering gap and toward the application surface is curved.

15. The application unit of claim 14, wherein the guiding surface is concavely curved in the direction over the gap toward the other lip as seen in the direction from the gap toward the application surface.

16. The application unit of claim 1, wherein the axis around which the guiding surface is pivotable is located beyond the metering gap, whereby pivoting of the guiding surface need not affect the metering gap.

17. The application unit for applying a fluid or pasty medium to an application surface moving past the application unit, the application unit comprising:

a free jet nozzle defining a metering gap, wherein the gap extends across the application surface moving past the gap, the nozzle metering gap being defined by a leading side lip defining and being located on the upstream leading side of the gap and a trailing side lip defining and being located on the downstream trailing side of the gap past which the application surface moves, the lips having outlet ends extending toward the application surface;

a fluid or pasty medium delivery device delivering fluid or pasty medium to the metering gap to be dispensed through the metering gap and the free jet nozzle to the application surface;

a fluid or pasty medium guiding surface arranged at the outlet end of one of the lips and extending beyond the metering gap, the guiding surface extending toward the application surface and adjoining the metering gap;

the guiding surface being supported to be pivotable in its orientation with respect to both the application surface and the metering gap for the guiding surface to pivot around an axis extending across the application surface and generally parallel to the longitudinal extension of the application unit;

setting means connected with the guiding surface for pivoting the guiding surface with respect to the one lip; the setting means comprises a swingable lever arm connected with the guiding surface such that swinging of the lever arm correspondingly pivots the guiding surface with respect to the one lip, and means engaging the lever arm for swinging the lever arm for pivoting the guiding surface.

18. The application unit of claim 17, wherein the application unit includes a stationary beam and the one lip is supported to the beam and the setting means is also supported to the beam.

19. The application unit for applying a fluid or pasty medium to an application surface moving past the application unit, the application unit comprising:

a free jet nozzle defining a metering gap, wherein the gap extends across the application surface moving past the gap, the nozzle metering gap being defined by a leading side lip defining and being located on the upstream leading side of the gap and a trailing side lip defining and being located on the downstream trailing side of the gap past which the application surface moves, the lips having outlet ends extending toward the application surface;

a fluid or pasty medium delivery device delivering fluid or pasty medium to the metering gap to be dispensed through the metering gap and the free jet nozzle to the application surface;

fluid or pasty medium guiding surface arranged at the outlet end of one of the lips and extending beyond the metering gap, the guiding surface extending toward the application surface and adjoining the metering gap;

the guiding surface being supported to be pivotable in its orientation with respect to both the application surface and the metering gap for the guiding surface to pivot around an axis extending across the application surface and generally parallel to the longitudinal extension of the application unit;

the application unit includes a stationary beam and the one lip is supported to the beam;

a separate setting device connected with the one lip in the portion of the one lip defining the metering gap upstream of and before the free jet nozzle, the setting device being adjustable with reference to the beam for adjusting the metering gap;

the pivotable support being between the one lip and the guiding surface, whereby the position of the one lip with respect to the other lip is adjustable and the position of the guiding surface is independently adjustable with reference to the one lip.

20. The application unit of claim 19, wherein the setting means comprises a swingable lever arm connected with the guiding surface such that swinging of the lever arm correspondingly pivots the guiding surface with respect to the one lip, and means engaging the lever arm for swinging the lever arm for pivoting the guiding surface.

21. The application unit of claim 20, further comprising a second mechanical setting mechanism comprising:

a second lever connected with the one lip generally at the metering gap, and a second adjustment mechanism connected with the second lever for swinging the second lever around a second axis extending longitudinally of the application unit and across the application surface.

22. The application unit of claim 21, further comprising a second hinge and joint between the beam and the one lip connected with the second lever, enabling the second lever to pivot at the second hinge and joint with respect to the beam.

* * * * *